US008966798B1

(12) United States Patent
Sanzo

(10) Patent No.: US 8,966,798 B1
(45) **Date of Patent: *Mar. 3, 2015**

(54) RECOIL REDUCING BUFFER AND STOCK ADAPTOR FOR FIREARMS

(71) Applicant: John Sanzo, Hermitage, TN (US)

(72) Inventor: John Sanzo, Hermitage, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/224,714

(22) Filed: Mar. 25, 2014

Related U.S. Application Data

(63) Continuation-in-part of application No. 13/950,470, filed on Jul. 25, 2013, now Pat. No. 8,720,093.

(60) Provisional application No. 61/680,926, filed on Aug. 8, 2012.

(51) Int. Cl.
*F41A 25/00* (2006.01)

(52) U.S. Cl.
USPC ..... 42/1.06; 42/75.03

(58) Field of Classification Search
USPC ..... 42/1.06, 75.01, 75.03, 90, 106; 89/198
See application file for complete search history.

(56) References Cited

U.S. PATENT DOCUMENTS

| | | | |
|---|---|---|---|
| 7,444,775 | B1 | 11/2008 | Schuetz |
| 7,640,690 | B2 | 1/2010 | Hines |
| 8,176,668 | B2 | 5/2012 | Simms |
| 8,296,984 | B2 | 10/2012 | Kincel |
| 8,397,617 | B2 | 3/2013 | Shirts |
| 8,434,252 | B2 | 5/2013 | Holmberg |
| 2003/0140542 | A1 | 7/2003 | Kay |
| 2010/0071246 | A1 | 3/2010 | Vesligai |
| 2011/0154707 | A1 | 6/2011 | Noonan |
| 2012/0030983 | A1 | 2/2012 | Kuczynko |
| 2013/0212920 | A1 | 8/2013 | Law |

OTHER PUBLICATIONS

Ace HK 91 Receiver Block (HKRB). <http://web.archive.org/web/20110828082853/http://riflestocks.com/store/page7. html> and <http://www.hkweaponsystems.com/cgi-bin/forunns/ultimatebb.cgi?f=5&t=000545&ubb=get_topic>. Feb. 24, 2006.

Ace "Pig Nose" AR adaptor. <http://web.archive.org/web/20101209044927/http://www.rbprecision.com/id51.htm>. Oct. 9, 2010.

Hkpro.com forum thread entitled "Buttcap option for a PTR-91 POW?". Posts #1 and #2 by usernames "chead" and "The Great 308", respectively. <http://www.hkpro.com/forum/hk-clone-talk/141393-buttcap-options-ptr-91-pdw.html>. Jun. 8, 2011.

*Primary Examiner* — Gabriel Klein
(74) *Attorney, Agent, or Firm* — Waller Lansden Dortch & Davis, LLP; Eric B. Fugett

(57) ABSTRACT

A recoil reducing buffer and stock adaptor having a front portion adapted to fit into and connectively engage with the backplate of an H&K-style rifle and a rear portion comprising an aperture adapted to accept and connectively engage with an AR-15/M16 buffer tube. The adaptor attaches to an H&K-style rifle between the action or receiver and the buttstock and allows the rifle to accept and function with a larger and/or stronger H&K-style rifle buffer than its original factory-installed buffer. The adaptor reduces the recoil of an H&K-style rifle by allowing the rifle to function with a larger and/or stronger H&K-style recoil buffer than its original factory-installed buffer. The adaptor also makes substantially all existing H&K-style rifles compatible with substantially all current and existing H&K-style rifle stocks and AR-style rifle stocks and stock accessories.

20 Claims, 8 Drawing Sheets

FIG.3

RECOIL REDUCING BUFFER AND STOCK ADAPTOR FOR FIREARMS

CROSS-REFERENCE TO RELATED APPLICATIONS

The present application is a continuation in-part of U.S. patent application Ser. No. 13/950,470, filed Jul. 25, 2013, which claims priority benefit of U.S. Provisional Patent Application No. 61/680,926, filed Aug. 8, 2012, both of which are herein incorporated by reference in their entirety.

FIELD OF USE

The invention relates to the field of firearms, specifically firearm accessories, buffer and/or stock adaptors and devices for reducing the recoil of automatic and semi-automatic rifles.

BACKGROUND

Most modern rifles today are shoulder-mounted, magazine-fed and fire centerfire cartridges. Such rifles may be fully automatic (i.e., fire continuously as long as the trigger is depressed), semi-automatic (i.e., fire only one round per each trigger pull) or bolt action (i.e., require manual reload after each round is fired). While fully automatic and bolt action rifles are primarily employed for combat and hunting applications, respectively, semi-automatic rifles are regularly used by both law enforcement and civilians for hunting, self-defense and sporting applications throughout the United States.

HECKLER & KOCH ("H&K") is a popular manufacturer of high-quality automatic and semi-automatic hunting, sporting and tactical rifles. Because authentic H&K rifles are relatively expensive and widely sought after, a substantial market for H&K "clones" has developed. An H&K "clone" is a non-H&K manufactured firearm made to look and/or function like a firearm manufactured by H&K. Many H&K rifles and their clones (collectively, "H&K-style rifles") are chambered for such powerful cartridges as the 5.56 mm×45 NATO (the military equivalent to the 0.223 Remington) and the higher-powered 7.62 mm×51 NATO (the military equivalent to the .308 Winchester) rounds. H&K-style rifles also typically use large, heavy bolts that generate significant recoil energy as the bolt travels rearward upon discharge. Accordingly, H&K-style rifles are known throughout the shooting community for having substantially more recoil than other similarly chambered rifles.

Recoil (i.e., "kick") is the backward momentum generated by a firearm when it is discharged. According to Newton's third law, the recoil generated by discharging a firearm balances the forward momentum of the projectile and exhaust gases expelled during discharge. High-powered cartridges and/or rounds with greater mass produce significantly more recoil energy than low-powered cartridges and/or rounds with less mass. The momentum generated by discharging a shoulder-mounted firearm is transferred to the ground through the body of the shooter and perceived and/or felt by the shooter as recoil.

Perceived recoil is the way in which a shooter perceives the recoil of a firearm. Felt recoil is the amount of recoil actually imparted to a shooter by a discharging firearm. Whereas perceived recoil differs between individuals, the felt recoil generated by a particular firearm is quantifiable and constant.

Perceived and felt recoil negatively impact a shooter's experience and performance by degrading accuracy, creating shooter fatigue, and increasing the time needed for reacquisition of a target between shots. For example, a firearm that is said to "kick like a mule" will be approached by a shooter with trepidation because the perceived recoil is high. Such a shooter will flinch in anticipation of the recoil while firing a shot, which can cause the shooter to jerk rather than smoothly squeeze the trigger. Such a jerking motion will disrupt the shooter's aim. Similarly, a firearm that transfers a large amount of felt recoil to the shooter can reduce the shooter's control over the firearm and make the firearm unpleasant to shoot.

Various mechanisms have been developed to reduce and/or improve felt and perceived recoil. The simplest of these involve the insertion of a lead wedge or other heavy object into one or more cavities in the buttstock of a firearm to increase its overall weight and reduce its momentum during firing. For example, U.S. Patent Application Publication No. 2011/0154707 to Noonan discloses a rifle stock having one or two cylindrical cavities adapted to accept an equal number of similarly sized cylindrical lead bars. While such devices can reduce felt and/or perceived recoil, they add unnecessary weight to the firearm, which can cause a shooter to tire during use. Additionally, these devices often fit the firearm poorly, which can permit the device to dislodge during use and disrupt a shooter's aim, damage the firearm, and/or cause significant injury.

Recoil pads are another type of simple device commonly used to limit recoil. They are typically made of resilient, deformable materials, such as rubber, foam, or leather, and are either attached to the buttstock of a rifle or worn between the buttstock and shoulder of the shooter. Recoil pads reduce perceived and/or felt recoil and prevent slippage of a firearm against a shooter's clothing by providing an additional layer of recoil-absorbing padding between a rifle's buttstock surface and the shooter's shoulder. However, recoil pads do not allow for the use of storage compartments commonly found in many modern synthetic rifle stocks and are not as effective as advanced recoil reducing systems.

Many advanced recoil reducing systems use reciprocating parts such as a hydraulic pistons or recoil spring buffer assemblies to dampen recoil. For example, a recoil spring buffer assembly is a mechanism that attaches to a rifle at the rear of the receiver and comprises a tube containing a spring with a plunger-like device (i.e., a buffer) positioned at the end of the spring nearest the receiver or action. The terms "action" and "receiver" and used interchangeably herein. Upon discharge, the rifle bolt travels rearward from the receiver, contacts the buffer and drives the buffer back into the buffer tube, compressing the buffer spring. The opposing force applied to the bolt by the compressing spring slows the momentum of the bolt, thereby reducing the amount of perceived and/or felt recoil imparted to the shooter. Though effective, these types of devices usually require custom gunsmithing to install, are expensive to manufacture, do not lend themselves to mass production, and are not ordinarily interchangeable between different firearms.

H&K-style rifles are typically manufactured with removable but non-interchangeable buffer assemblies that are notoriously ineffective at reducing the perceived and/or felt recoil of the rifle model for which they are designed. Specifically, the different models of H&K-style rifles are each equipped with differently sized buffers ranging from the small and light G3 standard buffer to the large and strong HK21E machine gun buffer. Because each model of rifle is designed to accept and function with a buffer of a specific size, H&K-style rifle buffers and their existing U.S.-made clones (collectively, "H&K-style buffers") are not interchangeable between different rifle models. H&K-style rifles are also incompatible with other more effective and modular recoil spring buffer systems such as the buffer assembly used in the AR-15/M16/M4 and AR-10 rifles (collectively, "AR-style rifles").

AR-style rifles have been used by the U.S. military since the 1960s and are currently one of the more popular style of rifles in the United States. The military success and famous modularity of the AR-style rifle has led to the development of a vast aftermarket for parts and accessories that easily bolt on to existing rifles of various makes. As a result, there are more aftermarket stocks and stock accessories for the AR-15 than any other firearm, including H&K-style rifles. However, AR-style rifle stocks and stock accessories are not compatible with existing H&K-style rifles because AR-style rifle stocks connect to the receiver via the buffer tube component of the rifle's buffer assembly.

Accordingly, there is a need and a demand for a prefabricated, inexpensive and lightweight device that can effectively reduce the amount of perceived and/or felt recoil of an existing H&K-style rifle without the need for custom gunsmithing. There is also a need and desire for a device that can adapt substantially all existing H&K-style rifles to be compatible with the full range of factory and aftermarket AR-style rifle stocks and stock accessories.

SUMMARY OF THE INVENTION

The present invention provides a prefabricated, lightweight recoil reducing buffer and stock adaptor that attaches to a firearm between the action or receiver and the buttstock. While there are many firearms that may benefit from this invention, the invention is particularly useful with H&K automatic and semi-automatic rifles and their clones. The recoil reducing buffer and stock adaptor of the invention may be machined from any suitably strong material. It is preferably machined from a block of T6 aluminum, steel or titanium.

In one aspect, the present invention provides a recoil reducing buffer adaptor that allows an H&K-style rifle to accept and function with a larger and/or stronger H&K-style buffer than the firearm was originally manufactured with, such as the HK21E machine gun buffer. The invention reduces felt and/or perceived recoil and user fatigue, and provides the shooter greater control over the firearm as well as improved reliability and enhanced accuracy by adapting an existing H&K-style rifle to function with a larger and/or stronger H&K-style buffer housed inside an AR-15/M16 buffer tube. In one embodiment, the invention also makes substantially all existing H&K-style rifles compatible with substantially all existing H&K-style buffers, regardless of size.

In another aspect, the present invention provides a stock adaptor for H&K-style rifles that allows an H&K-style rifle to accept and function with substantially all currently available factory and aftermarket AR-style rifle stocks and stock accessories. The invention makes substantially all current and existing AR-style rifle stocks and stock accessories compatible with substantially all existing H&K-style rifles by adapting an H&K-style rifle to accept and function with an AR-15/M16 buffer tube. In another embodiment, the invention is also compatible with substantially all existing fixed and telescopic H&K-style rifle stocks.

In yet another aspect, the invention provides a method for reducing the recoil of an H&K-style rifle by replacing the original factory buffer of an H&K-style rifle with a larger and/or stronger H&K-style buffer than the rifle was originally manufactured with, installing a recoil reducing buffer and stock adaptor of the present invention into the backplate of the rifle, threading an AR-15/M16 buffer tube into the adaptor to allow the larger and/or stronger H&K-style buffer to extend rearward from the backplate through the buffer tube, and installing a rifle stock over the buffer tube.

The invention, together with various embodiments thereof, is more fully explained by the accompanying drawings and the following detailed description thereof.

DETAILED DESCRIPTION OF THE INVENTION

In accordance with the present invention, a recoil reducing buffer and stock adaptor designed to allow an H&K-style rifle to function with a comparatively larger and/or stronger H&K-style buffer than its original factory-installed buffer is provided. The recoil reducing buffer and stock adaptor is a connector that couples the backplate of an H&K-style rifle to a standard AR-15/M16 buffer tube, which is used as a housing for a comparatively larger and/or stronger H&K-style buffer, such as the HK21E machine gun buffer.

The adaptor reduces perceived and/or felt recoil and user fatigue, and increases user safety and control over the firearm by adapting an existing H&K-style rifle to accept an AR-15/M16 buffer tube and function with a larger and/or stronger H&K-style buffer housed inside the AR-15/M16 buffer tube. The use of a larger and/or stronger H&K-style buffer provides a greater opposing force on the rifle bolt as it travels rearward during discharge, and thus reduces the amount of perceived and/or felt recoil.

By adapting an H&K-style rifle to accept an AR-15/M16 buffer tube, the invention also adapts substantially all existing H&K-style rifles to be compatible with substantially all currently available AR-style rifle stocks and stock accessories.

Figure 1:
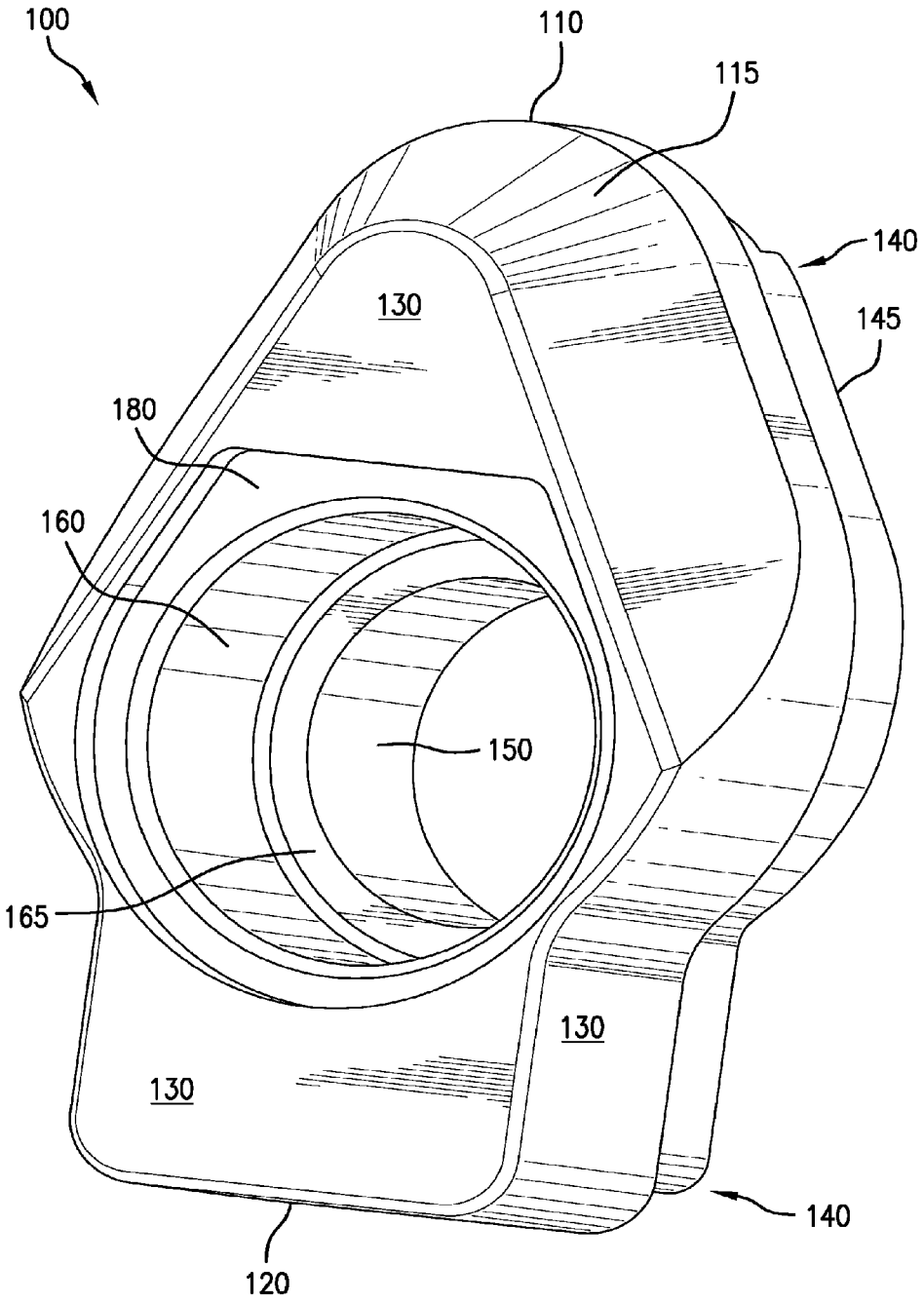
FIG. 1 is a rear quartering view of the recoil reducing buffer and stock adaptor of the present invention.

FIG. 1 illustrates a rear quartering view of a recoil reducing buffer and stock adaptor 100 in accordance with the present invention. As shown in FIG. 1, the adaptor 100 comprises a top 110, a bottom 120, a rear portion 130, and a front portion 140 opposite the rear portion 130. The front portion 140 comprises a neck 145 having a narrower profile than the rear portion 130, the neck 145 being sized and adapted to fit into and engage with a standard backplate of an H&K-style rifle. A buffer port 150 penetrates the adaptor 100 and extends axially through the width of the adaptor 100 at least from the surface of the front portion 140 to the point where the front portion 140 and rear portion 130 of the adaptor meet. In one embodiment, the buffer port extends axially through the adaptor 100 from the surface of the front portion 140 to a depth of approximately 0.50 inches. In another embodiment, the buffer port extends axially through the adaptor 100 from the surface of the front portion 140 to a depth of exactly 0.50 inches. The buffer port 150 is sized and adapted to accept and function with substantially all existing H&K-style rifle buffers, including those manufactured for such H&K-style rifles as the HK21, HK91 and MSG90 models. In one embodiment, the buffer port 150 is approximately 1.00 inches in diameter. In another embodiment, the buffer port 150 is exactly 1.00 inches in diameter.

The rear portion 130 of the adaptor is configured with a larger concentric buffer tube aperture 160 situated around the point where the buffer port 150 terminates in the rear portion 130 of the adaptor 100. The buffer tube aperture 160 is sized and adapted to accept an AR-15/M16 buffer tube. In one embodiment, the buffer tube aperture 160 is approximately 1.148 inches in diameter. In another embodiment, the buffer tube aperture 160 is approximately 1.168 inches in diameter. The buffer tube aperture 160 extends from the exterior surface of the rear portion 130 of the adaptor 100 to a depth corresponding approximately to the point where the rear portion 130 and the front portion 140 of the adaptor 100 meet. In one embodiment, the buffer tube aperture 160 extends to a depth of approximately 0.750 inches. In another embodiment, the buffer tube aperture 160 extends to a depth of exactly 0.750 inches. In preferred embodiments, the buffer tube aperture 160 is threaded to accept an AR-15/M16 buffer tube. In some embodiments, the buffer tube aperture 160 is threaded with Mil-Spec threads to accept a Mil-Spec AR-15/M16 buffer tube. In yet other embodiments, the buffer tube aperture 160 is threaded with Comm-Spec threads to accept a Comm-Spec AR-15/M16 buffer tube. The interior of the buffer tube aperture 160 comprises a flat bottom surface or buffer stop 165 that encircles the buffer port 150 and provides a surface for the buffer tube to abut against.

The rear portion 130 of the adaptor is also configured with a recessed area 180 set around the buffer tube aperture 160 that is designed and adapted to accept a retaining collar for holding the adaptor 100 in position on a buffer tube with a locking nut (e.g., a castle nut). Preferably, the retaining collar is configured with one or more detents adapted to engage said locking nut. The upper edge 115 of the rear portion 130 of the adaptor 100 may be beveled or otherwise adapted to simulate the contouring of the upper portion of an H&K-style rifle backplate. This beveled edge 115 adds to the aesthetic appeal of the recoil reducing buffer and stock adaptor 100, reduces unnecessary weight and ensures that the adaptor 100 will not snag a user's clothing or gear during use. In one embodiment, the profile of the rear portion 130 of the adaptor 100 substantially matches the profile of the backplate of an H&K-style rifle so that the adaptor 100 appears to be an extension of the backplate when installed on an H&K-style rifle.

Figure 2:
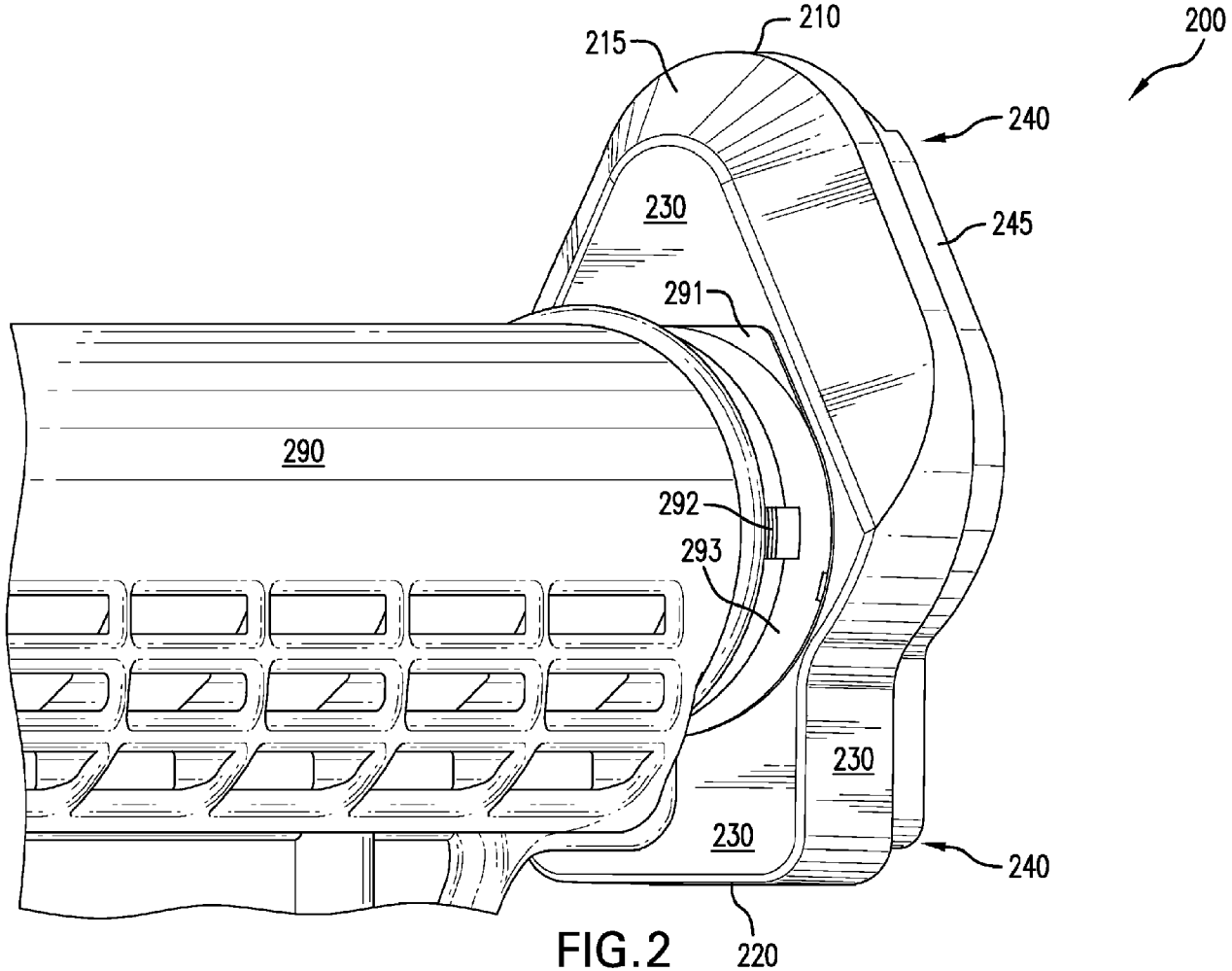
FIG. 2 is a rear quartering view of the recoil reducing buffer and stock adaptor of the present invention installed on a synthetic rifle stock.

FIG. 2 illustrates a rear quartering view of the recoil reducing buffer and stock adaptor 200 of the present invention installed on a synthetic rifle stock 290. The rear portion 230 of the adaptor 200 is oriented toward the rifle stock 290, while the front portion 240 of the adaptor 200 comprising the neck 245 adapted to fit into and connectively engage with the backplate of an H&K-style firearm is oriented away from the rifle stock 290. The rifle stock 290 is connected to the adaptor 200 via a buffer tube 292. The buffer tube 292 is threaded into the buffer tube aperture and held in place by a locking nut 293 engaged with a retaining collar 291 positioned in the recessed area of the rear portion 230 of the adaptor 200. The beveled edge 215 adapted to simulate the contouring of an H&K-style rifle backplate is shown near the top 210 of the rear portion 230 of the adaptor 200.

Figure 3:
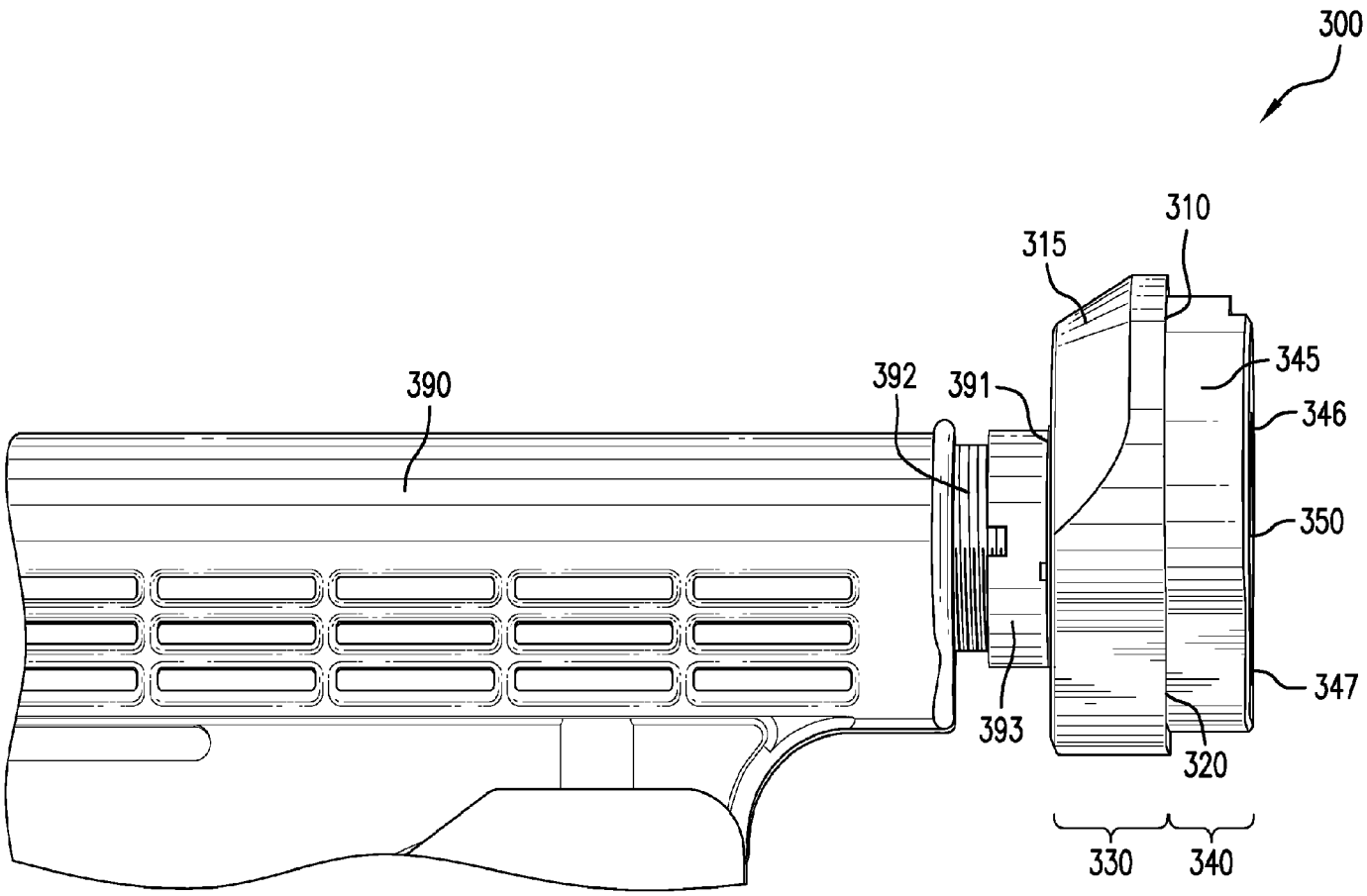
FIG. 3 is a side view of the recoil reducing buffer and stock adaptor of the present invention installed on a synthetic rifle stock.

FIG. 3 illustrates a side view of the recoil reducing buffer and stock adaptor 300 of the present invention installed on a synthetic rifle stock 390. A threaded buffer tube 392 connects the adaptor 300 to the rifle stock 390. As in FIG. 2, the buffer tube 392 is threaded into the buffer tube aperture and held in place by a locking nut 393 engaged with a retaining collar 391 positioned in the recessed area of the rear portion 330 of the adaptor 300. The rifle stock 390 is positioned over and attached to the buffer tube 392 so that the buffer tube extends internally through the stock 390. In one embodiment, the profile of the rear portion 330 of the adaptor 300 substantially matches the profile of an H&K-style rifle backplate. In another embodiment, the beveled edge 315 near the top 310 of the rear portion 330 simulates the contouring of an H&K-style rifle backplate when the adaptor 300 is installed thereon.

The neck 345 of the front portion 340 of the recoil reducing buffer and stock adaptor 300 extends oppositely from the rear portion 330 of the adaptor that engages the buffer tube 392. The comparatively narrower profile of the neck 345 sized and adapted to fit into and engage with the backplate of an H&K-style rifle is evident near the top 310 and bottom 320 of the adaptor 300. The front portion 340 of the adaptor 300 is configured with two buffer screw holes 346, 347 that index to and align with the buffer screw holes in a standard H&K-style rifle backplate. The upper buffer screw hole 346 is positioned above the buffer port 350 and the lower buffer screw hole 347 is positioned below the buffer port 350.

The recoil reducing buffer and stock adaptor 300 is installed into the backplate of an H&K-style rifle by inserting the neck 345 of the front portion 340 into the backplate of an H&K-style rifle. The adaptor 300 is then secured in place against the backplate by securely threading the rifle's original or existing buffer screws through the original or existing buffer screw holes in the backplate and into the buffer screw holes 346, 347 of the adaptor 300.

Figure 4:
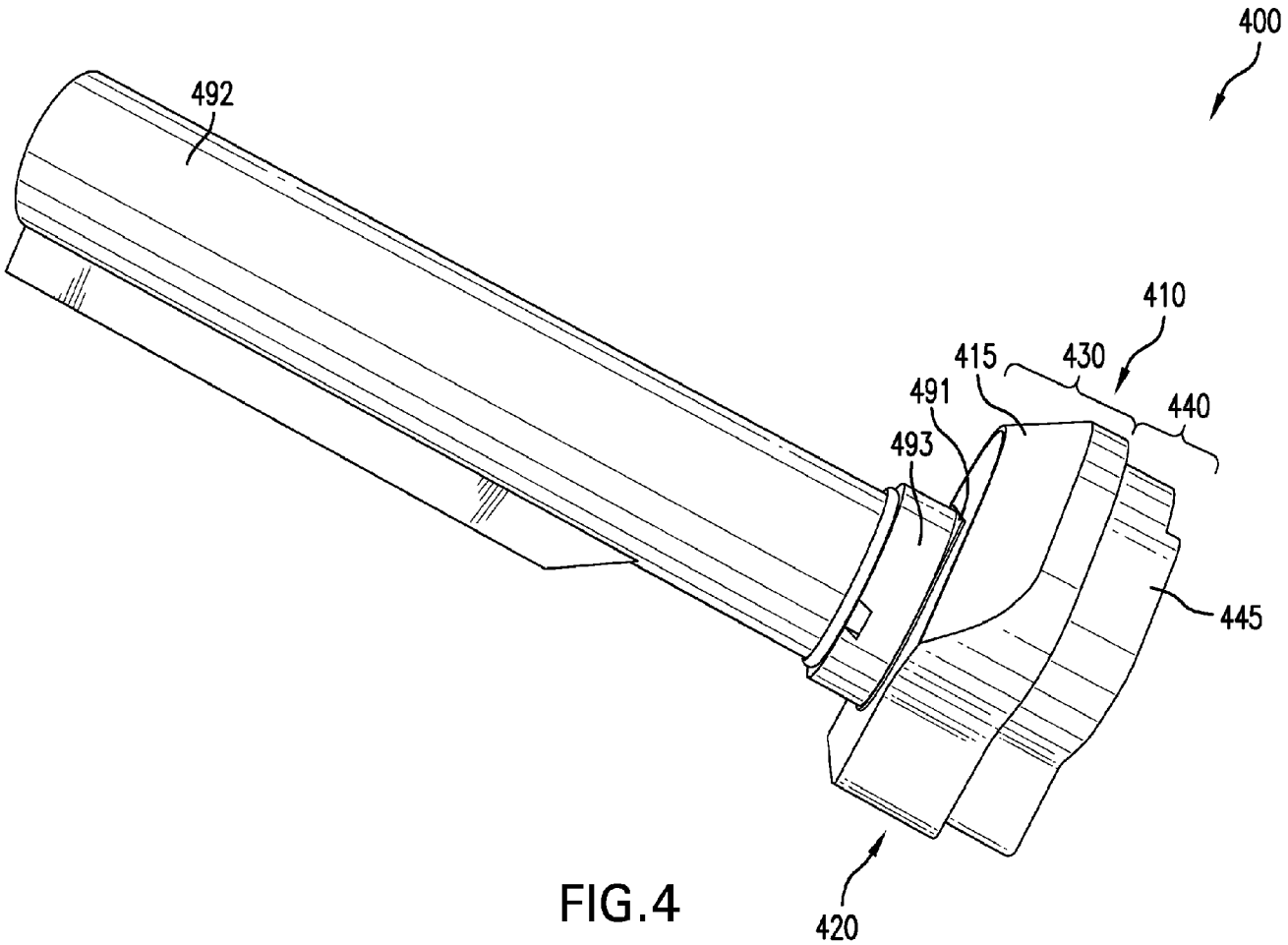
FIG. 4 is a rear quartering view of the recoil reducing buffer and stock adaptor of the present invention installed on an AR-15/M16 buffer tube.

FIG. 4 illustrates a rear quartering view of the recoil reducing buffer and stock adaptor 400 of the present invention installed on an AR-15/M16 buffer tube 492. The buffer tube 492 is threaded into the buffer tube aperture and held in place by a locking nut 493 engaged with a retaining collar 491 positioned in the recessed area of the rear portion 430 of the adaptor 400. The beveled edge 415 near the top 410 of the rear portion 430 faces toward the buffer tube 492, while the neck 445 of the front portion 440 sized and adapted to fit into and engage with an H&K-style rifle backplate extends away from the rear portion 430 of the adaptor 400. The narrower profile of the neck 445 is particularly distinct near the top 410 and bottom 420 of the adaptor 400.

Figure 5:
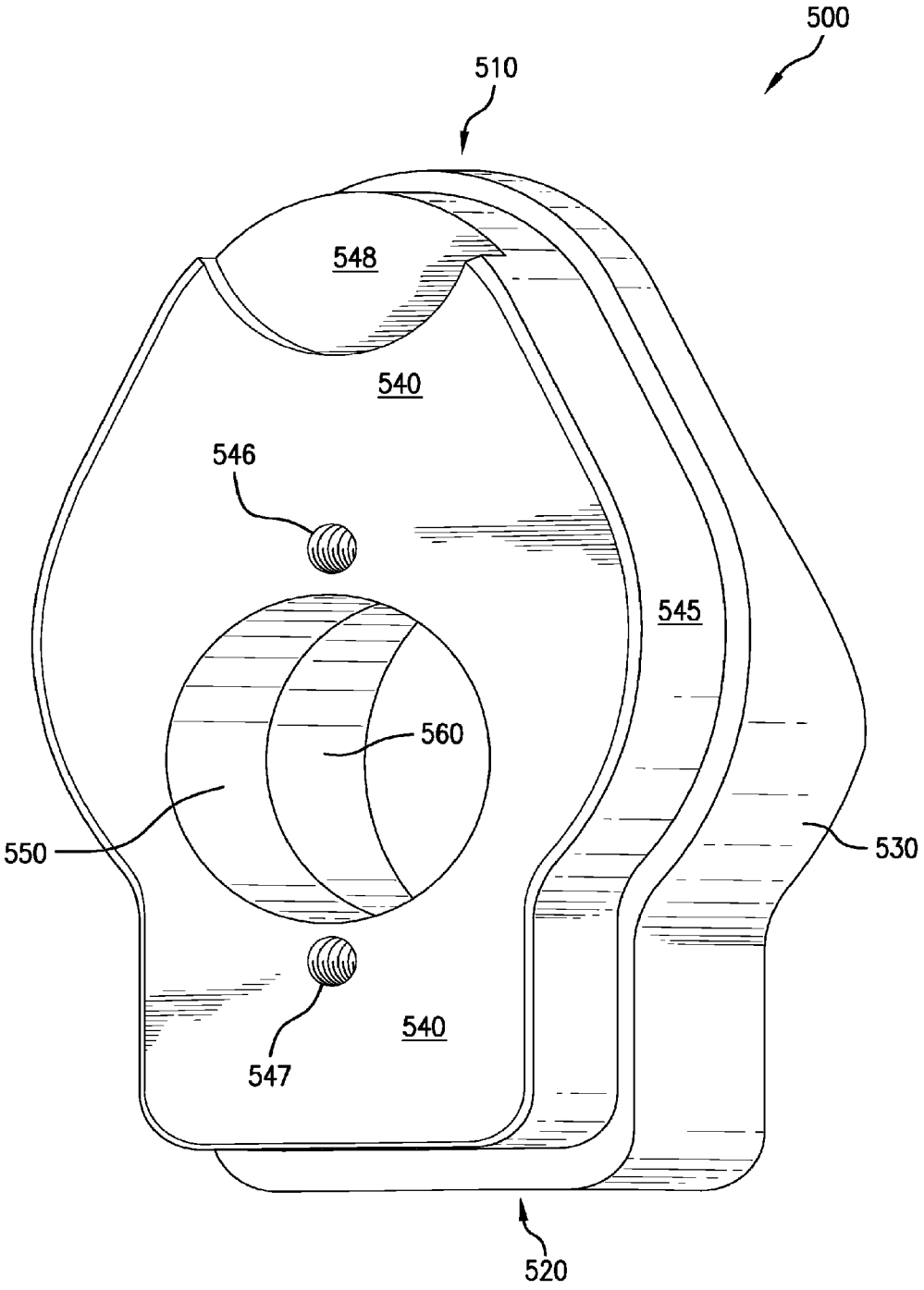
FIG. 5 is a front quartering view of the recoil reducing buffer and stock adaptor of the present invention.

FIG. 5 illustrates a front quartering view of the recoil reducing buffer and stock adaptor 500 of the present invention. The neck 545 of the front portion 540 protrudes from and has a narrower profile than the rear portion 530 of the adaptor 500. The front portion 540 is configured with two buffer screw holes 546, 547 that index to and align with the buffer screw holes native to a standard H&K-style rifle backplate. The upper and lower buffer screw holes 546, 547 are positioned longitudinally between the buffer port 550 and the top 510 and bottom 520 of the adaptor 500, respectively. The comparatively larger inside diameter of the buffer tube aperture 560 is visible through the buffer port 550 extending axially from the surface of the front portion 540 to the point where the front portion and the rear portion 530 of the adaptor 500 meet. In one embodiment, the top 510 of the front portion 540 of the adaptor 500 is also configured with a cavity 548 adapted to accommodate a portion of a recoil spring guide rod rivet or other similar geometry protruding from the rear of an H&K-style rifle backplate so as to allow the adaptor 500 to abut flush against the backplate of an H&K-style rifle when installed.

Figure 6:
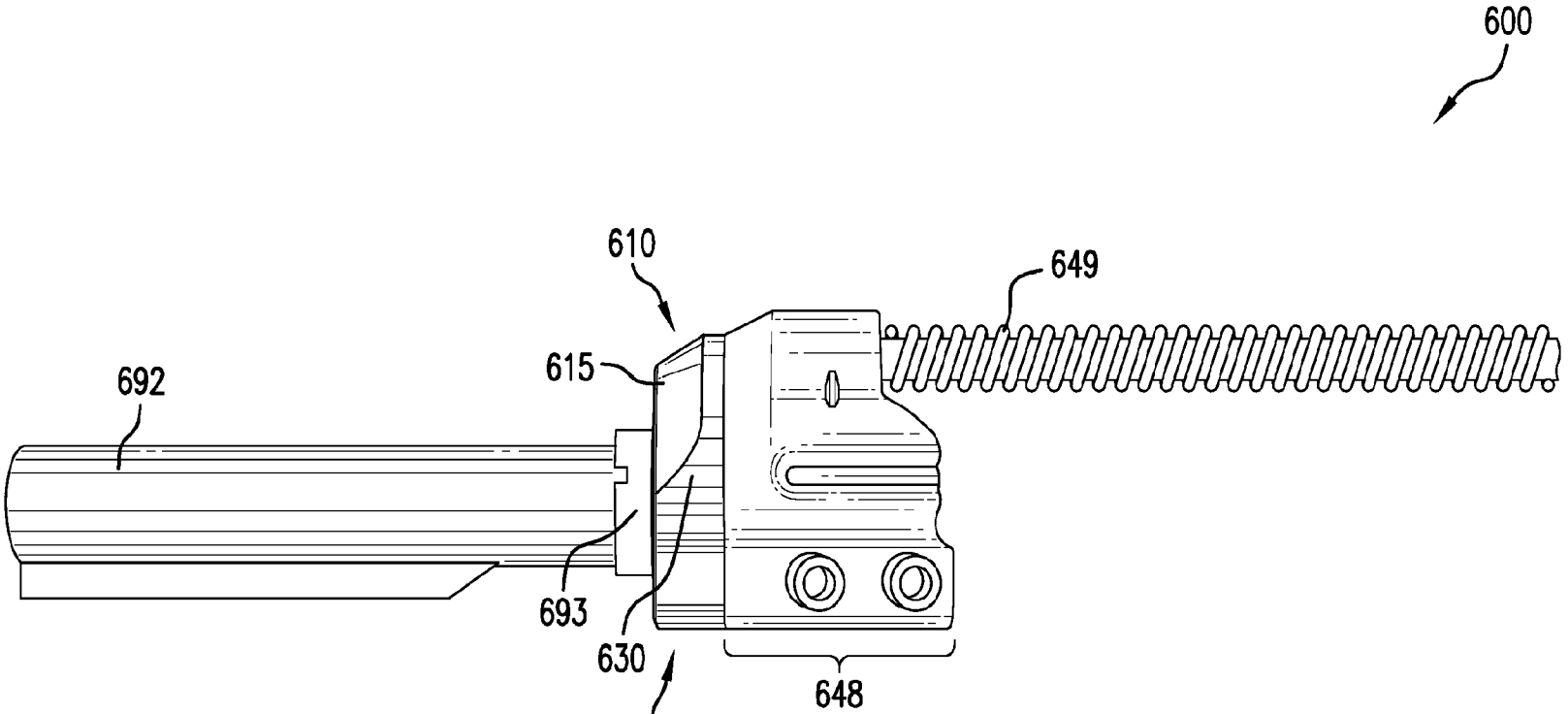
FIG. 6 is a side view of the recoil reducing buffer and stock adaptor of the present invention assembled with an H&K style rifle backplate and an AR-15/M16 buffer tube.

FIG. 6 illustrates a side view of the recoil reducing buffer and stock adaptor 600 of the present invention assembled with an H&K style rifle backplate 648 and an AR-15/M16 buffer tube 692. The rear portion 630 of the adaptor 600 extends rearward from the backplate 648 opposite a recoil spring and guide rod assembly 649. The profile of the rear portion 630 of the adaptor 600 substantially matches the profile of the backplate 648, particularly near the bottom 620 of adaptor, while the beveled edge 615 near the top 610 of the adaptor 600 simulates the contouring of the upper portion of the backplate 648. The buffer tube 692 extends rearward from the rear portion 630 of the adaptor 600 and is secured in place in the buffer tube aperture by a locking nut 693 engaged with a retaining collar positioned in the recessed area of the rear portion 630 of the adaptor 600.

Figure 8:
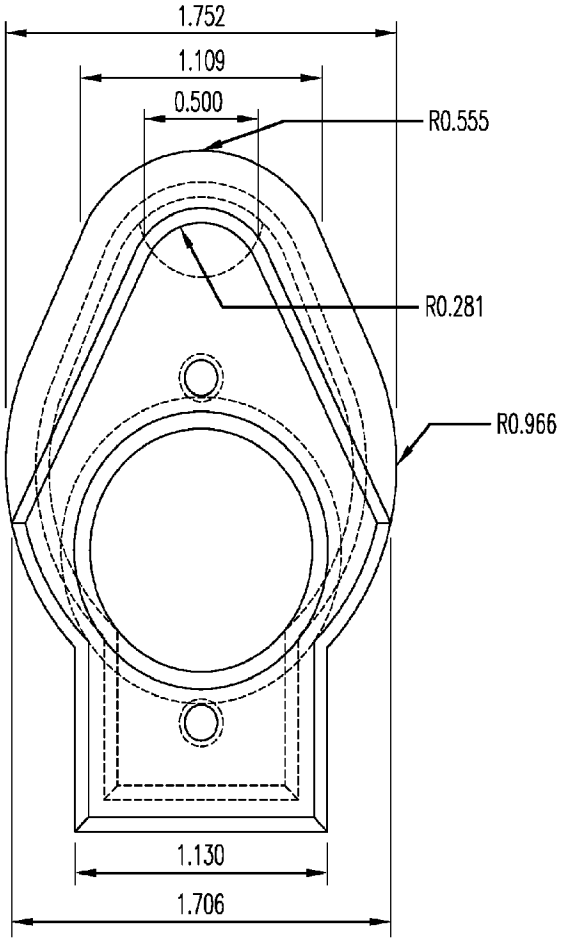
FIG. 8 is a schematic rear view of the recoil reducing buffer and stock adaptor of the present invention.
Figure 7:
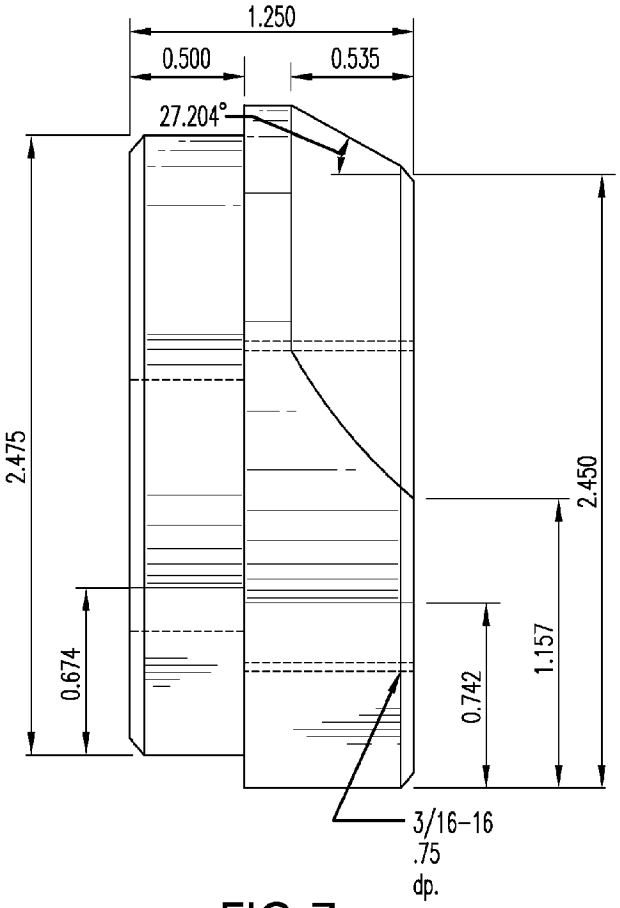
FIG. 7 is a schematic side view of the recoil reducing buffer and stock adaptor of the present invention.
Figure 9:
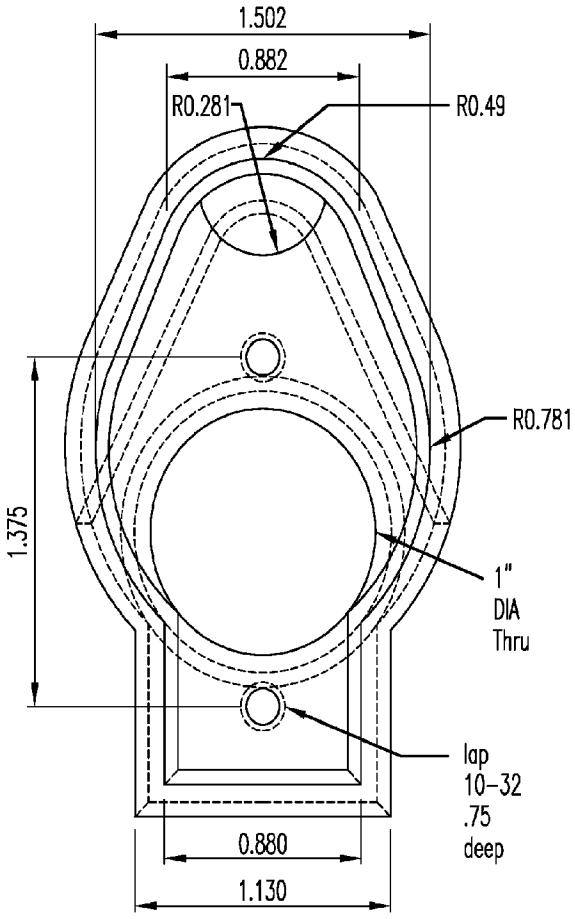
FIG. 9 is a schematic front view of the recoil reducing buffer and stock adaptor of the present invention.

FIGS. 7, 8 and 9 illustrate schematic side, rear and front views, respectively, of the recoil reducing buffer and stock adaptor of the present invention. Dimensions are provided in inches.

What is claimed is:

1. A prefabricated, one piece buffer and stock adaptor for a firearm, comprising:

a top, a bottom, a right side, a left side opposite the right side, a rear portion comprising a buffer tube aperture configured to accept and connectively engage with a buffer tube for a semi-automatic rifle, said buffer tube aperture having an interior bottom surface and a diameter of approximately 1.168 inches; and a front portion opposite said rear portion, said front portion comprising:

a forwardly protruding neck configured to fit into and connectively engage with a backplate configured to close the rear end of a receiver of a semi-automatic rifle, the backplate having two factory buffer screw holes, said neck comprising a narrower profile than said rear portion, a front surface with a transverse width of less than 1.752 inches, and a thickness, the thickness being less than the transverse width and the narrower profile generally defining a shape comprising an ovoid superjacent a rectangle; and a buffer port extending axially from said front surface to said interior bottom surface of said buffer tube aperture such that said port and said aperture connect to allow a buffer engaged with said backplate to extend rearward through said adaptor;

wherein said adaptor is removably attachable to said buffer tube and to said backplate to adapt said rifle to be compatible with rifle stocks which connect to the receiver of a rifle via a buffer tube.

2. The adaptor of claim 1, wherein said buffer port has a smaller diameter than said buffer tube aperture.

3. The adaptor of claim 1, wherein said factory buffer screw holes in said backplate are positioned along a longitudinal axis extending from a top to a bottom of said backplate.

4. The adaptor of claim 1, wherein said front portion further comprises two buffer screw holes disposed along a longitudinal axis extending from a top to a bottom of said adaptor that index to and align with the factory buffer screw holes in said backplate.

5. The adaptor of claim 4, wherein said buffer port is disposed on said longitudinal axis between said buffer screw holes.

6. The adaptor of claim 1, wherein said buffer tube aperture is threaded to accept a buffer tube having threads selected from the group consisting of Mil-Spec threads and Comm-Spec threads.

7. The adaptor of claim 1, wherein said rear portion further comprises a recessed area set around said buffer tube aperture, said recessed area being adapted to receive a retaining collar.

8. The adaptor of claim 2, wherein said buffer tube aperture extends axially from a rear exterior surface of said rear portion through at least a portion of said rear portion to a depth corresponding approximately to a point where said rear portion and said front portion meet such that the interior bottom surface of said aperture encircles said buffer port.

9. The adaptor of claim 1, wherein said adaptor adapts said rifle to be compatible with a larger or stronger buffer than its original factory-installed buffer.

10. The adaptor of claim 1, wherein said front portion further comprises a cavity adapted to receive a portion of a recoil spring guide rod rivet protruding from said backplate.

11. A prefabricated, one piece buffer and stock adaptor for a firearm, comprising:

a top, a bottom, a right side, a left side opposite the right side;

a rear portion comprising a buffer tube aperture configured to accept and connectively engage with a buffer tube for a semi-automatic rifle, said buffer tube aperture having an interior bottom surface and a diameter of approximately 1.168 inches; and a front portion opposite the rear portion, said front portion comprising:

a forwardly protruding neck configured to fit into and connectively engage with a backplate at the rear end of a receiver of a semi-automatic rifle, said backplate being innately incompatible with said buffer tube and configured with two factory buffer screw holes for engaging a buffer, said neck having a front surface, a thickness of less than 0.535 inches, a transverse width, the width being greater than the thickness, and a smaller profile than said rear portion, said smaller profile generally defining a shape comprising an ovoid superjacent a rectangle;

a buffer port extending axially from said front surface though said neck to the interior bottom surface of said buffer tube aperture such that said port and said aperture connect to allow a buffer engaged with said backplate to extend rearward through said adaptor;

an upper buffer screw hole disposed above said buffer port; and a lower buffer screw hole disposed below said buffer port;

wherein said adaptor is removably attachable to said buffer tube and to said backplate.

12. The adaptor of claim 11, wherein said buffer tube houses a buffer designed to engage with said backplate.

13. The adaptor of claim 11, wherein said buffer tube aperture has a diameter greater than the diameter of said buffer port such that said interior bottom surface of the buffer tube aperture encircles said buffer port and provides a stop for said buffer tube to abut against.

14. The adaptor of claim 11, wherein said upper and lower buffer screw holes index to and align with the factory buffer screw holes in said backplate.

15. The adaptor of claim 11, wherein said buffer tube aperture is threaded to accept a buffer tube having threads selected from the group consisting of Mil-Spec threads and Comm-Spec threads.

16. The adaptor of claim 11, wherein said rear portion further comprises a recessed area set around said buffer tube aperture, said recessed area being adapted to receive a retaining collar.

17. The adaptor of claim 11, wherein said adaptor adapts said rifle to be compatible with a larger or stronger rifle buffer than the rifle was originally manufactured with.

18. The adaptor of claim 11, wherein said adaptor is generally symmetrical about a vertical plane extending through a longitudinal axis extending from the front portion to the rear portion of the adaptor.

19. The adaptor of claim 11, wherein said adaptor adapts said rifle to be compatible with rifle stocks which connect to the receiver of a semi-automatic rifle via a buffer tube.

20. The adaptor of claim 11, wherein said front portion further comprises a cavity for receiving a portion of a recoil spring guide rod rivet protruding from said backplate.

* * * * *